US008667758B2

(12) United States Patent
Fernandez Fernandez

(10) Patent No.: US 8,667,758 B2
(45) Date of Patent: Mar. 11, 2014

(54) COVERING FOR VERTICAL SURFACES AND ROOFS

(75) Inventor: Javier Fernandez Fernandez, Vigo (ES)

(73) Assignee: Cupa Innovacion S.L.U., Vigo, Pontevedra (ES)

( * ) Notice: Subject to any disclaimer, the term of this patent is extended or adjusted under 35 U.S.C. 154(b) by 0 days.

(21) Appl. No.: 13/254,780

(22) PCT Filed: Mar. 5, 2010

(86) PCT No.: PCT/ES2010/000091

§ 371 (c)(1),
(2), (4) Date: Nov. 14, 2011

(87) PCT Pub. No.: WO2010/100300

PCT Pub. Date: Sep. 10, 2010

(65) Prior Publication Data

US 2012/0055111 A1 Mar. 8, 2012

(30) Foreign Application Priority Data

Mar. 5, 2009 (ES) ..... 200900622

(51) Int. Cl.
*E04D 1/00* (2006.01)
*E04D 1/22* (2006.01)

(52) U.S. Cl.
USPC ..... 52/543; 52/545; 52/549; 52/551

(58) Field of Classification Search
USPC ..... 52/518, 543, 547, 548, 551, 544, 545, 52/549, 550
IPC ..... E04D 1/12
See application file for complete search history.

(56) References Cited

U.S. PATENT DOCUMENTS

| | | | | | |
|---|---|---|---|---|---|
| 623,988 | A | * | 5/1899 | Contant | 52/26 |
| 718,165 | A | * | 1/1903 | Sneden | 52/548 |
| 899,968 | A | * | 9/1908 | Goldberg | 411/486 |
| 1,102,680 | A | * | 7/1914 | Overbury | 52/543 |
| 1,544,392 | A | * | 6/1925 | Budd et al. | 52/547 |
| 2,149,818 | A | * | 3/1939 | North | 52/409 |
| 2,756,699 | A | * | 7/1956 | Lockwood | 52/546 |
| RE24,246 | E | * | 12/1956 | Fink et al. | 52/543 |
| 4,574,536 | A | * | 3/1986 | Bamber et al. | 52/125.3 |
| 5,165,642 | A | * | 11/1992 | Rihaly | 248/237 |
| 5,531,334 | A | * | 7/1996 | Forby | 211/119 |
| 5,946,876 | A | * | 9/1999 | Grace et al. | 52/520 |
| 5,950,387 | A | * | 9/1999 | Stahl et al. | 52/559 |
| 6,052,961 | A | | 4/2000 | Gibbs et al. | |
| 6,367,220 | B1 | * | 4/2002 | Krause et al. | 52/512 |
| 6,516,572 | B1 | * | 2/2003 | Nowacek et al. | 52/90.1 |

(Continued)

FOREIGN PATENT DOCUMENTS

| | | | | | |
|---|---|---|---|---|---|
| EP | 1 688 554 | A1 | | 8/2006 | |
| GB | 2000208 | A | * | 1/1979 | E04G 23/04 |
| JP | 05052005 | A | * | 3/1993 | E04D 3/00 |
| JP | 7-317223 | A | | 12/1995 | |

*Primary Examiner* — Charles A Fox
*Assistant Examiner* — Joseph J Sadlon
(74) *Attorney, Agent, or Firm* — Merchant & Gould P.C.

(57) ABSTRACT

Covering for a roof and vertical surfaces, constituted by a prefabricated element includes a base layer (1) of a waterproofing substrate; an upper covering (2) made of slate parts (3) fixed by adhesive. A mechanical fastener for the slate parts and anchor for anchoring the prefabricated element to the roof.

6 Claims, 5 Drawing Sheets

(56) References Cited

U.S. PATENT DOCUMENTS

| | | | | |
|---|---|---|---|---|
| 7,448,177 | B2 * | 11/2008 | McClintick | 52/551 |
| 7,454,873 | B2 * | 11/2008 | McClintick | 52/551 |
| 2002/0000068 | A1 * | 1/2002 | Freiborg et al. | 52/57 |
| 2003/0182887 | A1 * | 10/2003 | Shirota | 52/533 |
| 2004/0200174 | A1 * | 10/2004 | Register | 52/518 |
| 2006/0059832 | A1 | 3/2006 | McClintick et al. | |
| 2006/0080942 | A1 | 4/2006 | O'Neill et al. | |

* cited by examiner

COVERING FOR VERTICAL SURFACES AND ROOFS

This application is a National Stage Application of PCT/ES2010/000091, filed 5 Mar. 2010, which claims benefit of Serial No. P200900622, filed 5 Mar. 2009 in Spain and which applications are incorporated herein by reference. To the extent appropriate, a claim of priority is made to each of the above disclosed applications.

FIELD OF THE INVENTION

The object of the present invention is a covering for roofs and vertical surfaces, with natural slate finish, ensuring impermeability and the natural finish for a cover or vertical surfaces.

The object of the present invention is to facilitate the installation of the covering with natural slate finish, reducing the installation time and the required skilled labor, guaranteeing the integrity of the assembly and its durability.

BACKGROUND OF THE INVENTION

Slate is presented as a covering material, widely used in some regions of the world, which provides construction with an important amount of naturalness and beauty. Its exceptional behavior as regards the impermeability achieved on covers and its durability is remarkable (slate offers a 50 year durability warranty, which is impossible to achieve to this day by covering materials of synthetic origin).

As major weaknesses of slate we can mention its relatively high cost, due to the fact that the material itself results from a highly wasteful and mainly manual manufacturing process, and especially because the installation is slow and it implies the use of a large number of slate per square meter. On the other hand, the highly skilled labor required also has an influence on the product cost and on the limitation for entering new markets.

Slate is traditionally fixed mainly by two different systems:

A first method by nail fixing, characterized by:

- A part by part installation, with two nails per part. This causes the slowness of the installation, as well as possible slate breaking problems.
- Need for an initial on site layout, both vertical and horizontal, for the subsequent placing of slate parts, which has a negative impact on productivity.

A second method by hook fixing which is also characterized by:

- Its part by part installation, which makes it a slow process.
- Need for an initial on site layout, both horizontal and vertical, which has a negative impact on productivity.
- Fastening elements for the visible slate parts.

In general, solutions collected in prior art for fixing slate on covers are complex solutions requiring equally complex elements that do not allow simple access thereto. This generates cumbersome assemblies, difficult to carry and handle, increasing the price of the whole manufacturing process without the advantages thereof overcoming the problems.

Nowadays, the market goes in two directions, on the one hand technology is evolving along lines seeking the reduction of installation complexity. This is the case of the installation system known as project PGIDIT06DPI201E, as well as other existing products in the market with lesser scope and more limited capabilities.

On the other hand, "artificial" elements that are intended to imitate the natural appearance of slate are used. This is the case of ceramic tiles, the range of which includes dark grey flat parts that are presented with a finish similar to that of slate, although always without the natural appearance thereof. They are regular elements with an artificial appearance.

In this regard, we can highlight layer-type bituminous materials, designated as Shingle, whose shape corresponds to flat rectangular parts having a rough surface, the life of which is always limited to a maximum of around 20-25 years.

It should also be emphasized the use of metal or plastic plates imitating the slate finish, which do not satisfactorily achieve said finish nor have the same capabilities offered by natural slate, as regards durability, resistance to UV radiation, resistance to bending, impermeability, . . . derived from their physical and superficial properties.

Thus, although these products have a reduced cost and are quickly installed, neither their appearance nor their durability is by any means comparable to those of a natural slate cover (especially those made of plastic materials).

DESCRIPTION OF THE INVENTION

The present invention refers to a covering for roofs and vertical surfaces, which consists of a prefabricated element formed by a water-proofing element and slate parts which will provide it with natural appearance. The object of the invention is to simplify the assembling of a slate roof, with a panel that will allow a reduction of installation time by installing several slate parts at once, resulting in the same finish as a traditional slate covering and all that for a competitive cost compared to other covering materials (ceramic tiles, shingle, fiber cement, . . . ).

The present invention will enable to make a technological step, made before in other sectors such as wood (veneered board), wherein both materials have exclusively taken functions that cannot be performed by other materials with greater possibilities (regarding cost, manufacturing, molding capability, . . . ). Thus, slate would be the covering for a prefabricated element to which it would provide with its more remarkable characteristics (durability, resistance to UV radiation and low porosity, and especially natural aesthetic finish).

The covering of the invention is constituted from a prefabricated element comprising a base layer conceived through a waterproofing substrate, which may be made from aluminum, bituminous fabric, plastic elements, waterproofing fabric, etc., on which slate parts arranged in at least one row are fixed by means of adhesive. Epoxy resin, polyester resin, polyurethane glue, etc., can be used as a fixing adhesive for slate parts. The aforementioned covering also includes fastening means between the consecutive rows of slate parts, which allow having a mechanical joining which will prevent slate parts from becoming detached, thus avoiding its falling in case of a fastening failure by the adhesive. This mechanical joining further increases the resistance of the covering against the effects of wind conditions, ultimately obtaining a covering element with natural slate finish, whose final appearance does not differ from the traditional cover of this material.

Also, the covering includes anchorage means for the prefabricated element on the roof, in the form of nails, screws, rivets, etc.

In the covering of the invention the base layer of the prefabricated element serves as a supporting element for slate parts, forming together panels that are easily handled so as to form the covering. In each panel the base layer projects with respect to the surface covered by the slate parts along two of the edges of said surface, according to zones or portions that will overlap with adjacent panel layers, in the covering formation, thus ensuring the continuity and impermeability thereof.

The position of each panel or prefabricated element will be given by the previous panel or prefabricated element, in the covering formation.

In each panel or prefabricated element, the slate parts may be placed on the base layer forming a single row, placing in the covering the base layer of adjacent panels with the slate parts of consecutive rows partially overlapped with each other.

The aforementioned fastening means between partially overlapped slate parts of consecutive rows belonging to adjacent panels or prefabricated elements, are constituted by first hooks placed between parallel edges from which said overlap is formed, hooks which are fixed to the lower slate part and partially embrace the upper slate part, in each overlap. These hooks are fixed to the lower slate parts, one out of every two rows of partially overlapped slate parts, by means of nails or other fastening elements which are fixed to the roof and go through the hook, the slate part and the base layer through facing holes.

The aforementioned first hooks will be made of metal sheet and comprise three consecutive sections: a central section which is supported and fixed on the slate part, from the edge that is placed in lower position in the overlap of overlapped slate parts, a lower end section, which is supported on said edge placed in lower position, and an upper end section which projects upwards from the central section, with which it forms an angle that is equal to or less than 90°, and on which the edge of the slate part placed in upper position in the overlap of slate part belonging to consecutive rows will be supported.

According to a second embodiment, the base layer, which may be made of metal, plastic, ceramic, etc. is extended from the edge parallel to the row of the slate parts that projects from said row, in an upper wing that is upwardly bent, forming with said layer an angle that is less than 90°, while the opposite edge remains slightly retracted with respect to the parallel edge of the slate parts and is extended into a downwardly bent lower wing, forming with said layer an angle which is less than 90°. In the formation of the covering the lower wing of each base layer is coupled in the angle formed by the upper wing of the adjacent base layer, placed in lower position in the overlap.

Regarding the means for anchoring the covering to the roof, they consist of second hooks which are mounted on top of the lower wing of the base layer, and have an external extension which is supported and fixed on the roofs by a nail or a similar element.

On the slate part edge that is parallel to and projects from the lower wing of the base layer a third hook is coupled, which is extended underneath said slate parts and finishes in a bent pin which is coupled on top of said lower wing.

The base layer may form externally projecting nerves, parallel to the row of slate parts, as supporting elements on the roof.

The base layer may be metallic, for example made of aluminum, or it may be constituted by plastic materials, bituminous fabric, ceramic elements, etc.

In the covering formation, the cutting of the panels or prefabricated elements, comprising the base layer and the slate parts, would be done by a conventional machine, such as a jigsaw, circular saw, etc., so as to be adapted to the different joints that may exist on the roof.

The covering of the invention may be used on any type of roof, regardless of its size or inclination, for any type of house, garage, building, etc., and also as means for solving impermeability problems, leaving a good finish in all cases, such as valleys, hips, ridge, surface joining, skewing, etc. In addition, the covering may be placed on any type of substrate, such as concrete, wood, metal, etc.

Another advantage of the prefabricated element of the invention is that since it uses less slate than traditional systems, as a third overlap is not required, since the substrate is the waterproofing element, it will be possible to minimize the environmental degradation derived from slate extraction, allowing the exploitation of low cost slate, which will further allow helping to achieve sustainability of slate extraction and production.

The range of products will be as extensive as the one that exists for the slate market, offering the same visual appearance, with large and small slate, as well as different slate shapes (spade-shaped, rectangular, round . . . ).

According to another embodiment, the fastening means between partially overlapped slate parts of consecutive rows consist of fourth U-shaped wire hooks 27, one of whose branches runs among every two consecutive slate parts 3 and is topped in a downwardly bent section 28, which crosses the base layer 1, while the other hook branch 29 will run over said slate part, directed towards the projecting zone 5 of the base layer, so as to embrace the overlapped consecutive slate parts 3", from its lower edge 11.

BRIEF DESCRIPTION OF THE DRAWINGS

In the attached drawings it is shown a preferred embodiment of the covering of the invention, as a non-limiting example, where.

DETAILED DESCRIPTION OF A PREFERRED EMBODIMENT

Figure 1:
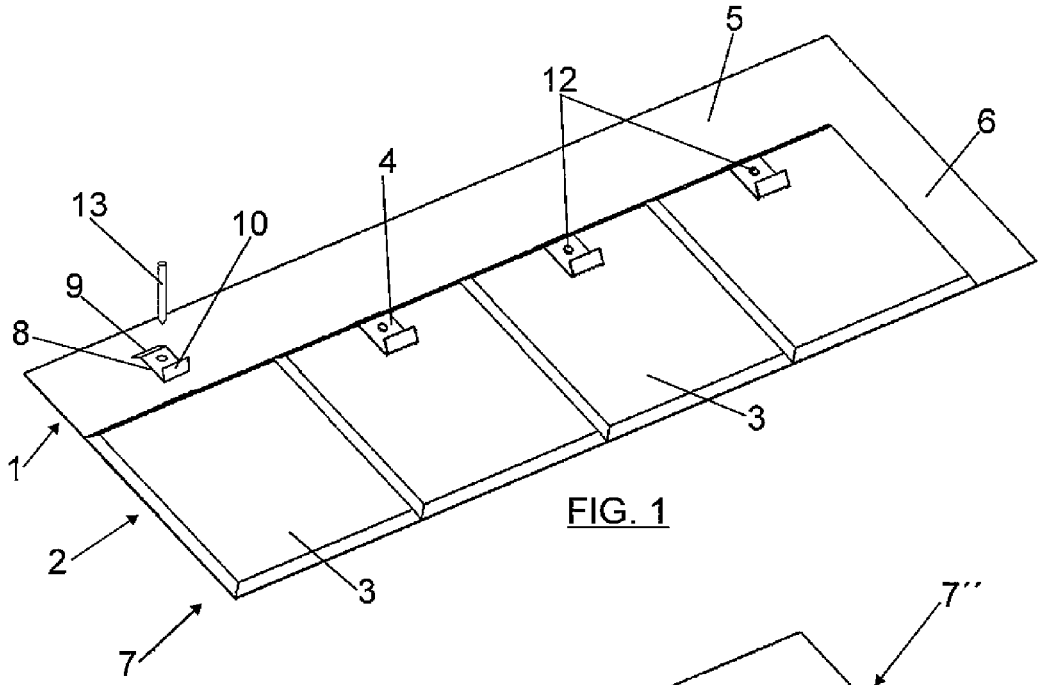
FIG. 1 is a perspective view of a prefabricated element for the formation of the covering of the invention, including the fastening means between the slate parts of consecutive rows.
Figure 3:
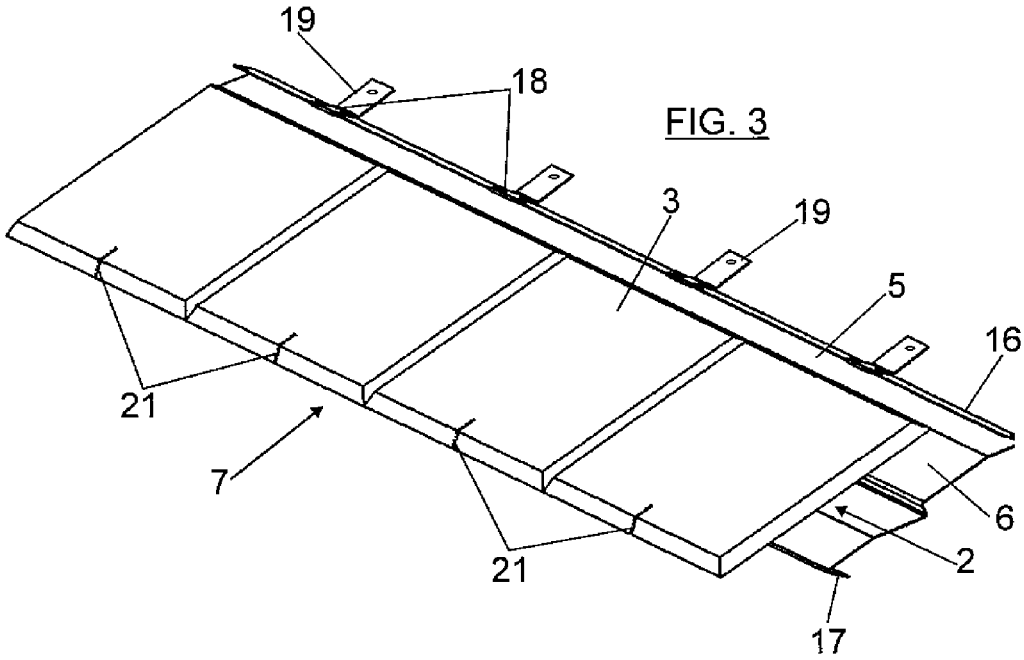
FIG. 3 is a perspective view similar to FIG. 1, showing an embodiment variant.
Figure 4:
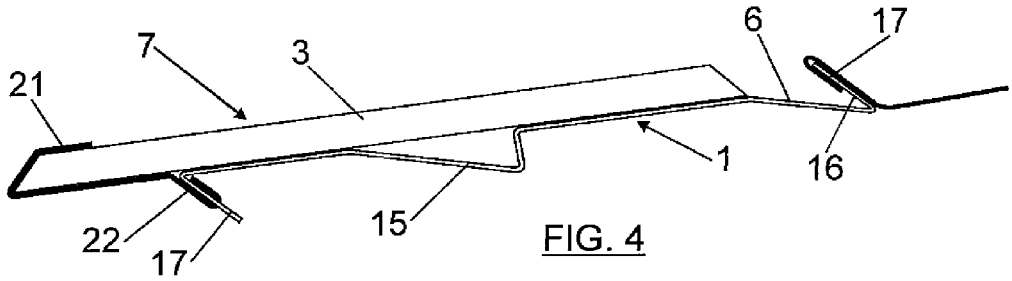
FIG. 4 is view of the profile of the prefabricated element of FIG. 3.

FIG. 1 shows a prefabricated element for the formation of the covering of the invention, which is constituted by a base layer 1 and an upper covering 2. The base layer 1 consists of a waterproofing substrate which can be metallic, for example aluminum, or it can be made of bituminous fabric, plastic, waterproofing fabric, etc. Regarding the upper covering 2, it consists of slate parts 3 which are fixed to the base layer by means of adhesive, for example, by epoxy resin, polyester resin, polyurethane glue, etc. Besides, slate parts 3 are fixed to the cover by means of fastening means which determine a mechanical joining and which in the example represented in FIGS. 1 and 3 are constituted by a first hook 4, made of metal sheet for example, which are placed and fixed as it will be explained below.

As it can be appreciated in FIG. 1, slate parts will be placed on the base layer 1 forming a single row. The base layer 1 serves as a supporting element for the slate parts 3 and projects, with respect to the surface occupied by the row of slate parts, along two of the edges of said surface in overlap portions 5 and 6 in the formation of the covering, as it will be explained with reference to FIG. 2.

The assembly of base layer and slate parts 3 fixed on said layer constitute a prefabricated element which will be designated in general with reference number 7.

Figure 2:
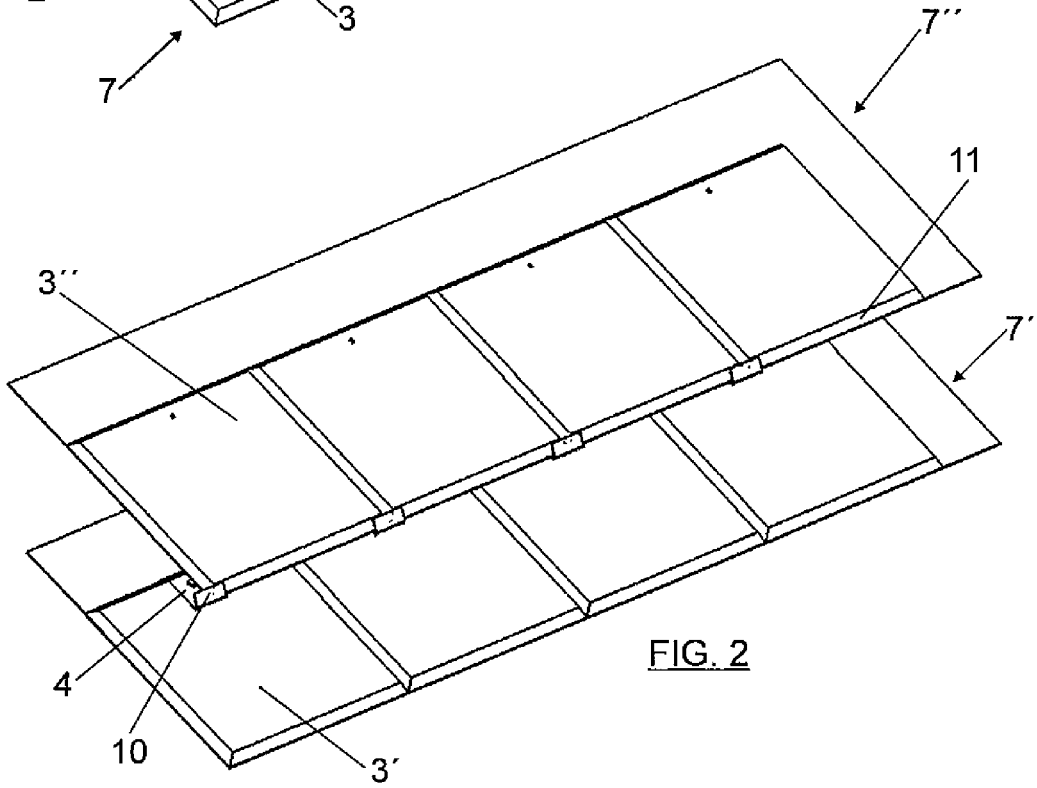
FIG. 2 is a perspective view of two consecutive prefabricated elements, partially overlapped, for the formation of the covering of the invention.

In the formation of the covering, as it can be appreciated in FIG. 2, the prefabricated elements 7 are placed so that the slate parts 3 thereof are partially overlapped, as well as the zones 5 and 6 of the base layer.

The first hooks 4 comprise, as it can be appreciated in FIG. 1, three consecutive sections: a central section 8, which is supported and fixed on the upper surface of the slate parts, from the edge thereof which becomes a part of the overlap in the placing of the consecutive prefabricated elements 7, FIG. 2; a lower end section 9, which is supported on said overlapping edge of slate parts; and an upper end section 10 which projects upwards with respect to the central section 8, with which it forms an angle which is equal to or smaller than 90°, and on which the edge 11 of the slate parts placed in upper position in the overlap of slate parts will be supported, as shown in FIG. 2.

In FIG. 2 two prefabricated elements placed for becoming a part of the covering of the invention are indicated with reference numbers 7' and 7". Slate parts 3' and 3" of these prefabricated elements remain partially overlapped, resting the slate parts 3" through the edge 11 against the upper end section 10 of the hooks 4.

As it can best be appreciated in FIG. 1, the central section 8 of the hooks 4 has a hole 12 which will face a hole of the slate parts 3 for inserting a nail, screw, rivet, etc., 13 which will serve as a means for fastening slate parts 3 to the base layer 1. These nails or screws 13 will project downwardly with respect to the base layer 1 in a section that will serve as a means for fixing the covering to the roof.

In the arrangement shown in FIG. 2 zones 5 and 6 of the base layer of the consecutive prefabricated elements remain overlapped for ensuring the covering waterproofing.

FIGS. 3 to 7 show an embodiment variant in which the base layer 1, which can be made of metal, plastic, ceramic, etc. forms nerves 15 that run parallel to the row 2 of slate parts 3. Besides, the zone 5 of the base layer that projects from the row 2 of slate parts 3 is topped by an upwardly bent upper wing 16, which forms with said layer an angle smaller than 90°. The opposite parallel edge of the base layer remains slightly retracted with respect to the adjacent parallel edge of the slate parts 3 and projects into a downwardly bent lower wing 17, which forms with said layer an angle smaller than 90°, all this as it can be appreciated in FIGS. 3 and 4.

Figure 6:
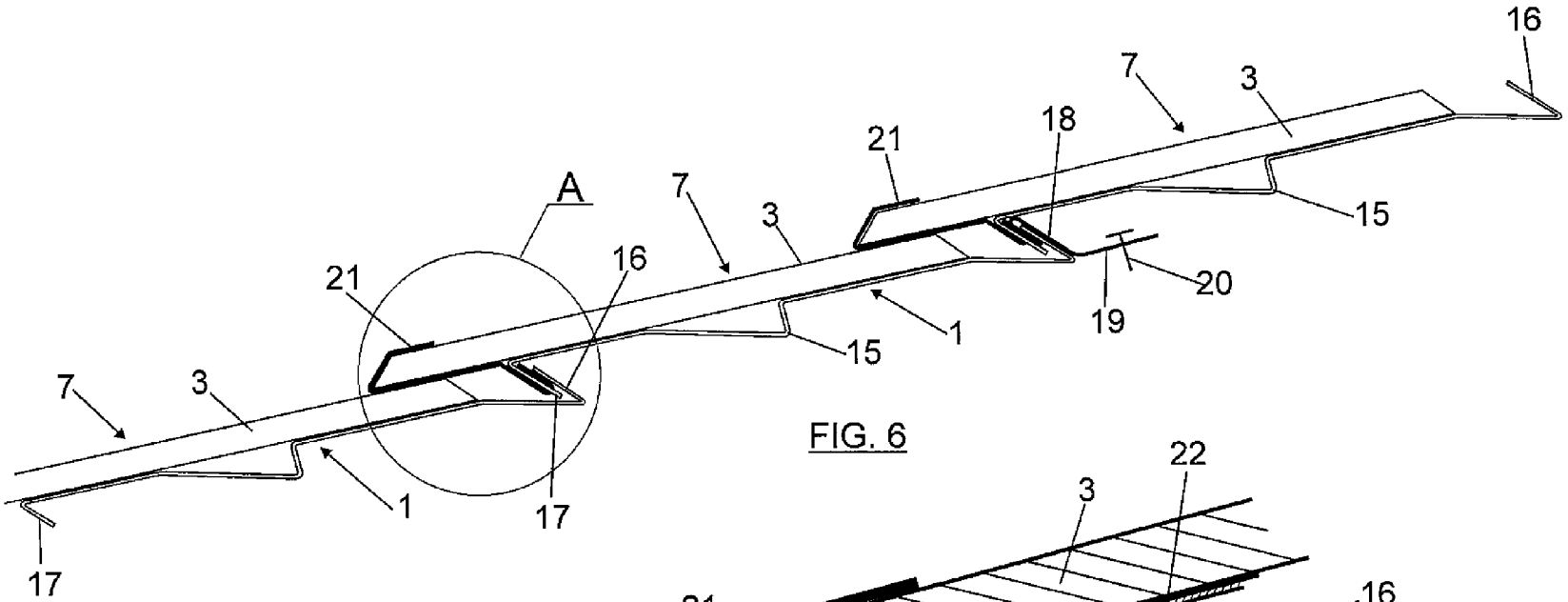
FIG. 6 shows a longitudinal section of the covering formed from the prefabricated elements of FIGS. 3 and 4.
Figure 7:
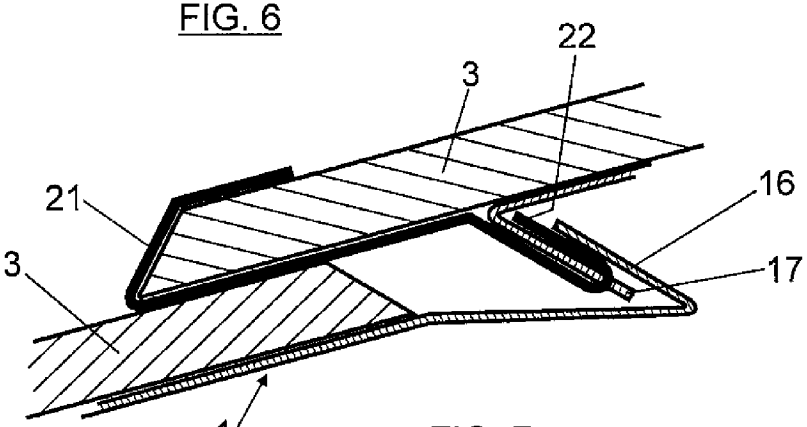
FIG. 7 corresponds to detail A of FIG. 6, at a larger scale.

In the covering formation, as it is shown in FIG. 6, the lower wing 17 of the base layer of each prefabricated element is coupled in the angle formed by the upper wing 16 of the prefabricated element which in the overlap occupies the immediately lower position. In this case the anchorage means to the roof consist of second hooks 18 made of metal sheet, FIGS. 3 and 6, which are mounted on top of the upper wing 16 of the base layer and have an end extension 19 which is supported and fixed on the roof by a nail 20 or a similar element, FIG. 6.

Figure 5:
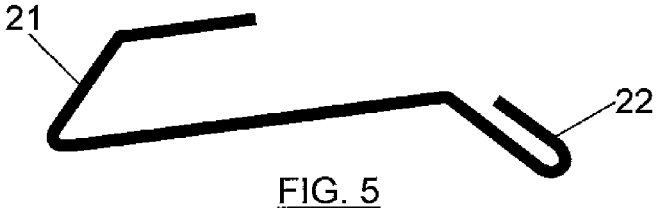
FIG. 5 is a perspective view of the third wire hook, which cooperates as a fastening means for slate parts in the second embodiment variant.

On the edge of slate parts 3 which project from the base layer 1 a third hook 21 is coupled, preferably made of wire, which is projected underneath the slate parts 3 in a pin 22, bent into an angle of 180°, which is coupled on the lower wing 17 of the base layer 1, for which said wing may have a slot from its free edge. FIG. 5 shows a perspective view of one of these third hooks 21, with the pin 22 bent into a 180° angle for its coupling onto the lower wing 17 of the base layer 1, showing in the detail of FIG. 7 the way in which these hooks 21 are mounted on the edge of the slate parts 3 and with the pin 22 coupled onto the lower wing 17 of the base layer 1.

The hooks 21, made of wire, will remain visible in the covering formation, simulating the anchorage means of the slate parts 3 in the traditional coverings. Also, these third hooks 21 serve as a fastening means for slate parts 3 preventing them from falling if the adhesive fails.

Figure 8:
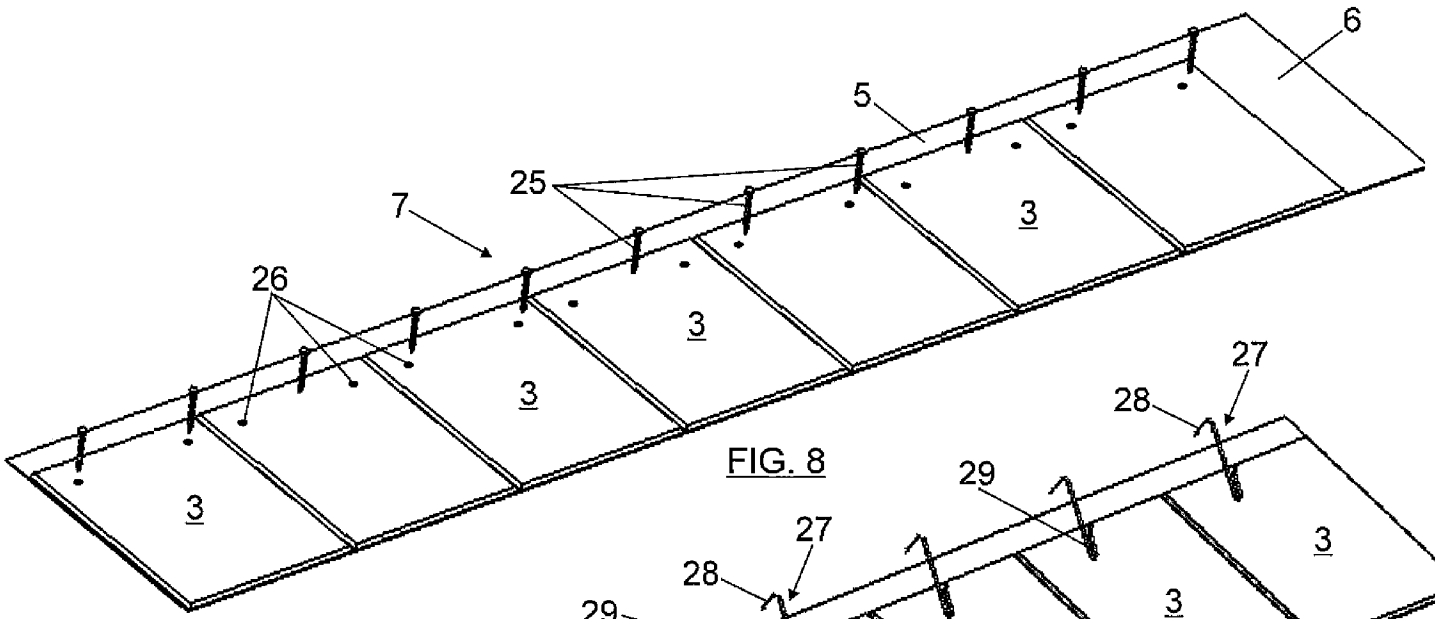
FIG. 8 is a similar view to FIG. 1, showing a fixing by means of nails.

In the embodiment shown in FIG. 8, the prefabricated elements or panels 7 are fixed to the cover or surface on which the covering will be formed, by means of nails 25 which go through the slate parts 3 and the base layer through the holes 26.

Figure 9:
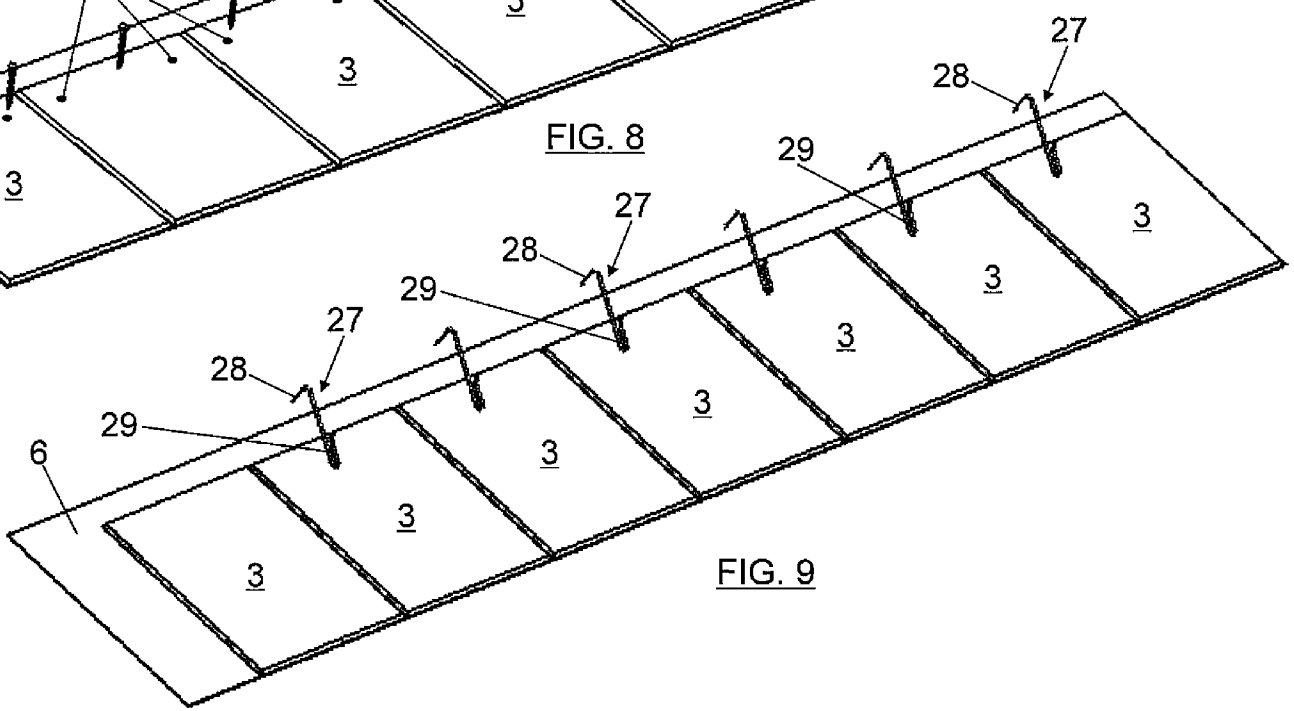
FIGS. 9 and 10 are similar views to FIG. 1, showing an embodiment variant, in two successive assembly stages.
Figure 10:
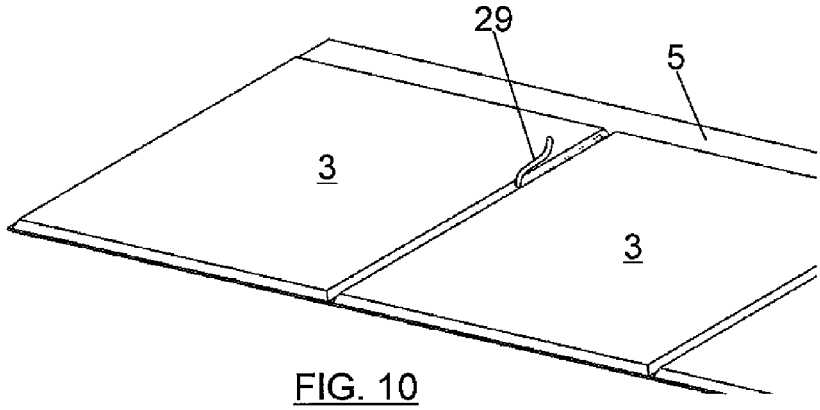
Figure 11:
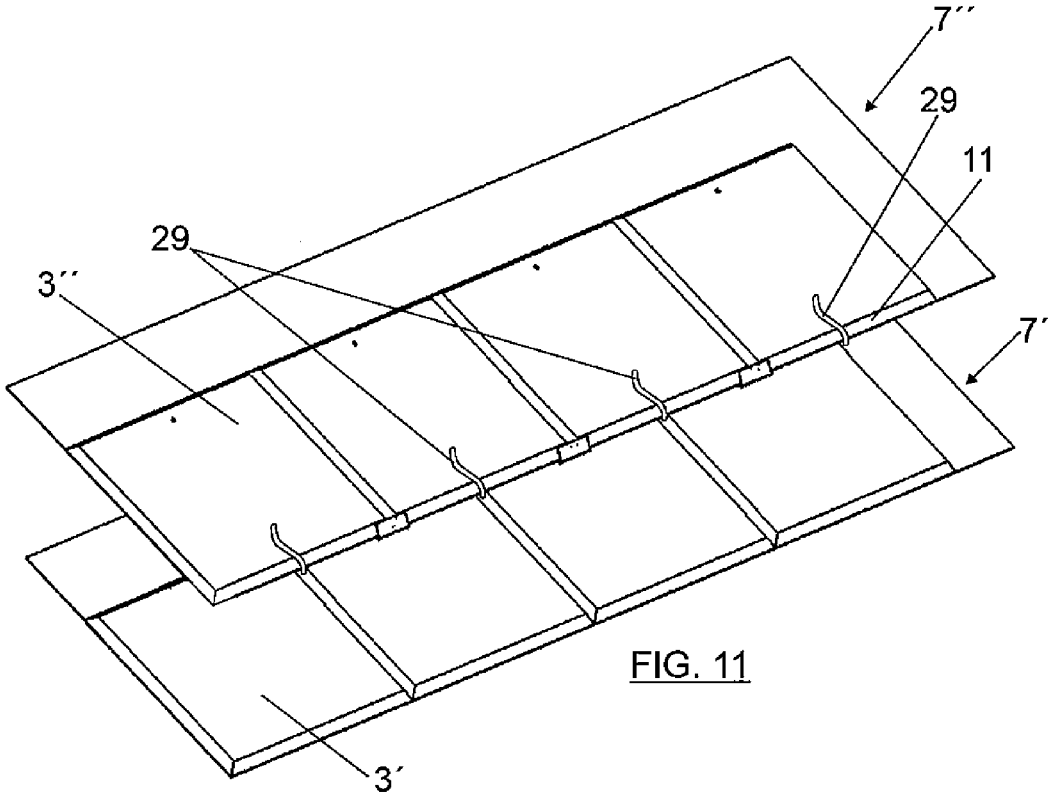
FIG. 11 is a similar view to FIG. 2, according to an embodiment variant of FIGS. 9 and 10.

FIGS. 9 to 11 show a fastening method between partially overlapped slate parts 3' and 3" based on a fourth type of hooks 27, with a constitution and arrangement similar to that of the hooks used in the traditional construction of coverings based on slate parts.

These hooks 27 are placed, as shown in FIG. 10, between every two consecutive slate parts of a row of a prefabricated element 7, with the end section 28 inserted through the holes of the base layer 1, to be nailed on the roof or surface to be covered, projecting the branch 29 of the hook with respect to the surface of the adjacent slate parts 3 and remaining directed towards the projecting zone 5 of the base layer 1

In the covering formation, FIG. 11, the hooks 27 that project between slate parts 3' of a panel 7', embrace the consecutive slate parts 3" of the adjacent panel 7", from the edge 11, the end section 29 of said hooks resting on the slate parts 3". In this way it is achieved an excellent fastening of both the slate parts with one another, and the covering assembly to the roof or surface to be covered.

The base layer 1 may have a line indicating the points where the hooks 27 must be nailed. Depending on the dimensions of the hook 27 used, the overlap dimension between slate parts 3' and 3" may be modified.

The visible end section 29 of the hook will simulate the covering construction using traditional systems.

The invention claimed is:

1. A prefabricated element for covering roofs and vertical surfaces, the prefabricated element comprising:

a base layer having a waterproofing substrate;

an upper covering, made of slate parts fixed by adhesive and placed in at least one row;

fastening means for mechanical fastening of the slate parts; and anchoring means for anchoring the prefabricated element to a roof;

wherein said base layer serves as a supporting element for the slate parts and projects, with respect to a surface covered by the slate parts, along two edges of said surface in zones overlapping with adjacent layers, in the formation of the covering;

wherein on each base layer the slate parts are placed forming a single row, the prefabricated elements being placed in the covering in an arrangement adjacent to the slate parts of consecutive rows partially overlapped with one another; and wherein the fastening means of the slate parts partially overlapped in consecutive rows comprise hooks arranged between parallel edges from which the overlapping is formed, said hooks being fixed to the lower slate parts and to the roof, and partially embracing the overlapping slate parts; and wherein the anchoring means to the roof comprise nails or joining elements which go through the hooks and are nailed in the roof;

wherein the anchoring means for anchoring the prefabricated element to the roof or surface to be covered comprise nails inserted through holes drilled in the slate parts; and wherein the hooks between the partially overlapped slate parts of consecutive rows are U-shaped wire hooks, one of whose branches runs between every two consecutive slate parts and finishes in a downwardly bent section, which goes through the base layer, while the other branch of the hook runs over said slate part, directed towards the projecting zone of the base layer, so as to embrace the consecutive overlapped slate parts approximately three inches from a lower edge.

2. The prefabricated element according to claim 1, wherein the hooks are first hooks which comprise three consecutive sections, a central section which is supported and fixed on an upper surface of the slate parts placed in a lower position in the overlap of slate parts, from the overlapped edge, a lower end section, which is supported on said overlapped edge of the same slate part, and an upper end section which projects upwards from the central section, with which the upper end section forms an angle that is equal to or smaller than 90°, on which an edge of the another slate part, placed in overlapping position in the overlap of slate parts, rests.

3. A prefabricated element for covering roofs and vertical surfaces, the prefabricated element comprising:

a base layer having a waterproofing substrate;

an upper covering, made of slate parts fixed by adhesive and placed in at least one row;

fastening means for mechanical fastening of the slate parts; and anchoring means for anchoring the prefabricated element to a roof;

wherein said base layer serves as a supporting element for the slate parts and projects, with respect to a surface covered by the slate parts, along two edges of said surface in zones overlapping with adjacent layers, in formation of the covering;

wherein on each base layer the slate parts are placed forming a single row, the prefabricated elements being placed in the covering in an arrangement adjacent to the slate parts of consecutive rows partially overlapped with one another;

wherein the fastening means of the slate parts partially overlapped in consecutive rows comprise hooks arranged between parallel edges from which the overlapping is formed, said hooks being fixed to the lower slate parts and to the roof, and partially embracing the overlapping slate parts; and wherein the anchoring means to the roof comprise nails or joining elements which go through the hooks and are nailed in the roof;

wherein the hooks are second hooks which comprise an end extension which is supported and fixed on the roof by a nail and wherein the base layer is extended, from the edge parallel to the row of slate parts that projects from said row, into an upper wing which is upwardly bent, forming with said layer an angle that is smaller than 90°, while the opposite edge remains slightly retracted with respect to the adjacent parallel edge of the slate parts and is extended in a downwardly bent lower wing, forming with said layer an angle that is smaller than 90°; the lower wing of each base layer being coupled in the formation of the covering to the angle formed by the upper wing of the adjacent base layer placed in lower position in the overlap, and wherein the second hooks are mounted on top of the upper wing of the base layer.

4. The prefabricated element according to claim 3, wherein on the slate part edge parallel to and projecting from the lower wing of the base layer a third hook is coupled, which is extended underneath said slate parts and finishes in a pin which is bent into a 180° angle which is coupled on said lower wing.

5. The prefabricated element according to claim 4, wherein the first and second hooks are made of metal sheet and the third hook is obtained from a metal rod.

6. The prefabricated element according to claim 3, wherein the base layer forms downwardly projecting nerves parallel to the row of slate parts, as a support on the roof.

* * * * *